United States Patent [19]

Schotter et al.

[11] 4,281,936

[45] Aug. 4, 1981

[54] PAINT MIXING AND CONDITIONING MACHINE

[75] Inventors: Richard D. Schotter, Glenwood; Robert P. Heinis, Totowa, both of N.J.

[73] Assignee: Red Devil, Inc., Union, N.J.

[21] Appl. No.: 93,591

[22] Filed: Nov. 13, 1979

[51] Int. Cl.[3] ..... B01F 9/00

[52] U.S. Cl. ..... 366/209; 366/233; 366/605

[58] Field of Search ..... 360/DIG. 605, 208, 209, 360/213, 214, 217, 219, 220, 233

[56] References Cited

U.S. PATENT DOCUMENTS

| | | | |
|---|---|---|---|
| 835,846 | 11/1906 | Blalock | 366/209 |
| 1,448,446 | 3/1923 | Hulbert . | |
| 1,463,626 | 7/1923 | Marrazzo . | |
| 1,755,763 | 4/1930 | Barber . | |
| 2,797,902 | 7/1957 | Beugler . | |
| 2,894,309 | 7/1959 | Brzowski . | |
| 3,018,092 | 1/1962 | Johnson . | |
| 3,229,964 | 1/1966 | Wiseman . | |
| 3,284,057 | 11/1966 | Duquette . | |
| 3,421,053 | 1/1969 | Rinard . | |
| 3,542,344 | 11/1970 | Oberhauser . | |
| 3,609,921 | 10/1971 | Foster | 366/219 |
| 3,706,443 | 12/1972 | Oberhauser . | |
| 3,735,962 | 5/1973 | Pagano . | |
| 3,880,408 | 4/1975 | Karjalainen . | |
| 4,146,335 | 3/1979 | Hutchings . | |

*Primary Examiner*—Robert W. Jenkins
*Attorney, Agent, or Firm*—Albert F. Kronman

[57] ABSTRACT

A paint mixing and conditioning apparatus in which a paint filled container is simultaneously tumbled end over end while being rotated about its longitudinal axis. The container is clamped to a pulley shaped disc which is rotatably carried by spaced resilient wheels journaled in an upstanding plate. The container clamp is disposed to extend across openings in the upstanding plate and disc. The pulley shaped disc is driven peripherally by a resilient drive wheel coupled to a power source to tumble the container. A beveled friction wheel, coupled to the container clamp and in frictional contact with the upstanding plate, rotates the container as the pulley shaped disc is turned.

6 Claims, 5 Drawing Figures

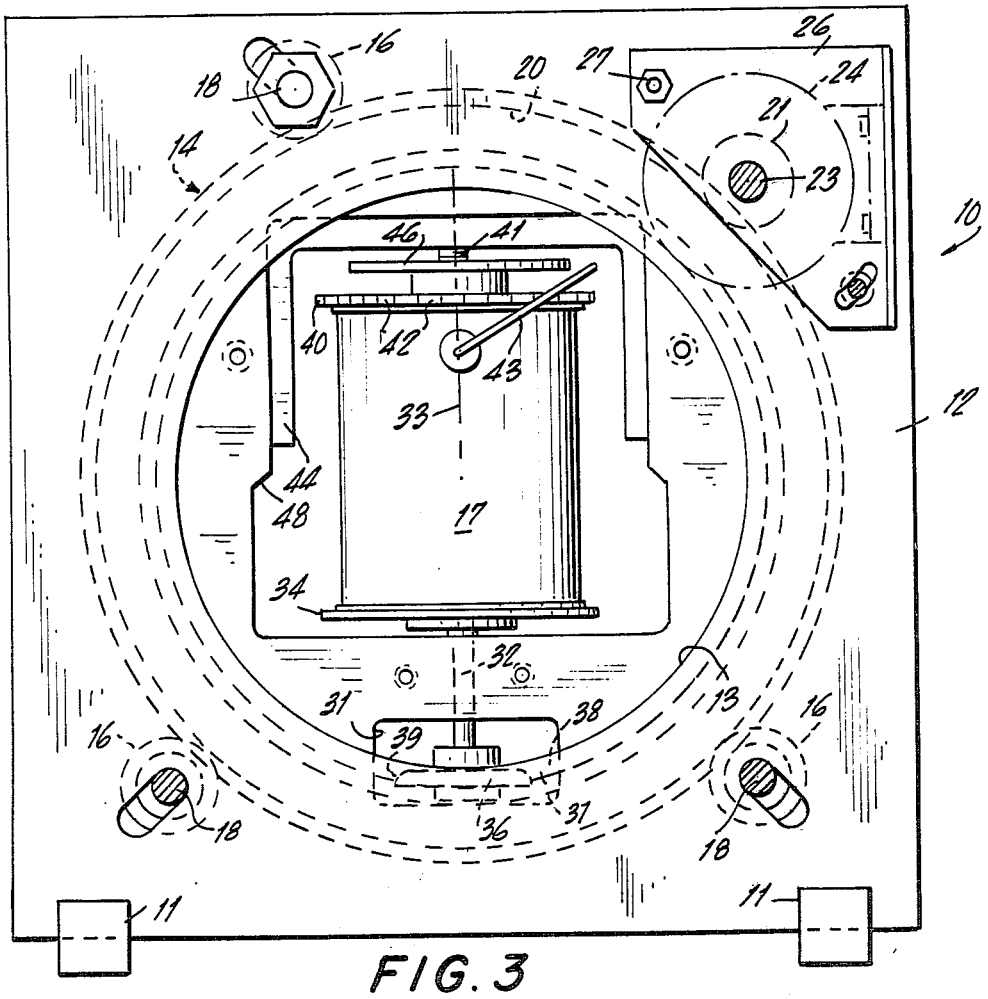
FIG. 3
FIG. 4
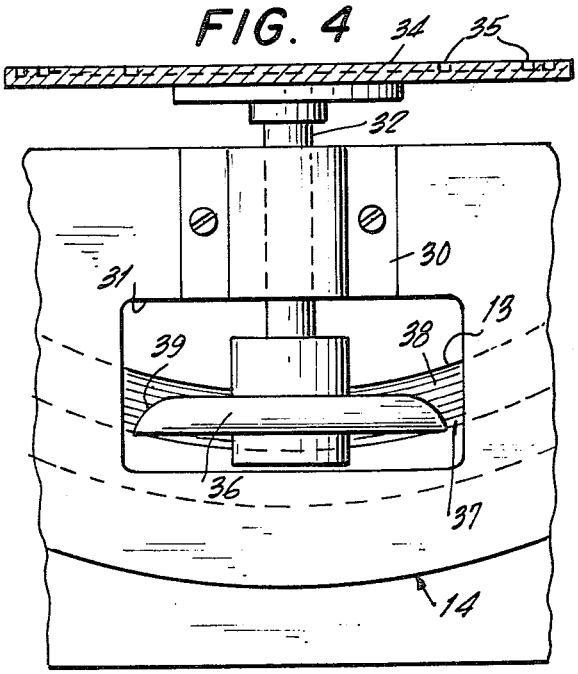
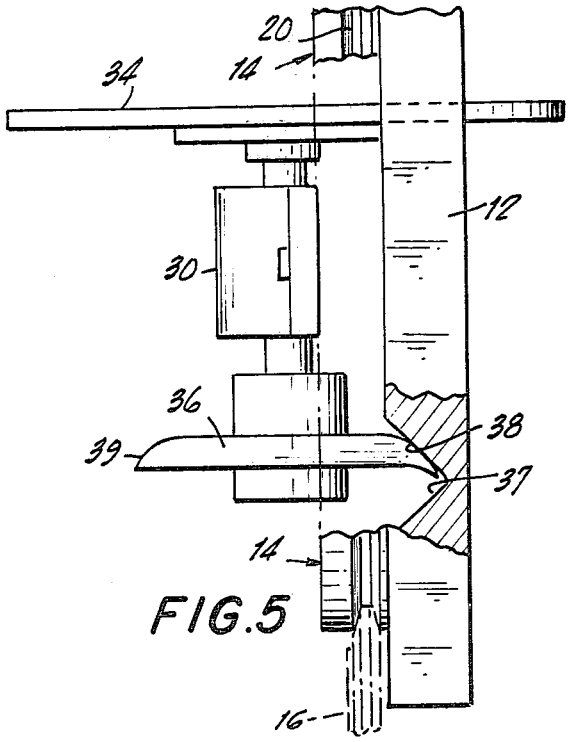
FIG. 5

PAINT MIXING AND CONDITIONING MACHINE

BACKGROUND OF THE INVENTION

Paint mixing or blending machines in which the contents of a can of paint is agitated by rapid shaking or rotating the can are well known. Previously known devices of this type, however, have generally been heavy, noisy and prone to such heavy vibration that they require anchoring to the floor of a building or some other substantial support. Despite rubber or spring mounts, their gyrations tend to cause damage to their supports and often their own mechanisms. In order to develop the motion necessary to mix the paint, substantial power sources consuming much energy are required. Some prior art devices also require substantial time for mixing.

Accordingly, it is an object of the present invention to provide a paint mixing or blending machine of relatively simple construction which will thoroughly mix or blend liquids such as paint in a short period of time.

Another object of the present invention is to provide a paint mixing machine in which the weight, including the container of paint, is substantially balanced during mixing to reduce vibration, noise and loads.

A further object of the present invention is to provide a paint mixing machine which can be loaded and unloaded quickly and easily.

Still another object of the present invention is to provide a paint mixing machine which is energy efficient, durable and useful for mixing cans of different sizes.

SUMMARY

In the preferred embodiment of the present invention, a vertically disposed support plate having a central aperture therein rotatably supports a pully shaped disc. The disc is formed with a window sufficiently large to receive the paint container so that the said container extends partially through the window and the support plate aperture. A circular bottom plate mounted on a shaft is freely carried by the disc and serves as the bottom portion of a clamp to secure the can within the machine. A vertically adjustable plate spaced from the first plate forms the upper portion of the clamp. A source of rotary power such as an electric motor is carried by the support plate and drives the disc by means of a wheel which bears against the periphery of the said disc. The motion imparts a tumbling motion to the can of paint. A beveled resilient wheel secured to the circular bottom plate is in frictional contact with a complimentary annular groove in the vertical support plate. As a result, when the disc is rotated the bottom plate will turn on an axis normal to that of the disc. The can of paint will, therefore, be rotated about the said axis. The combined tumbling and rotating motion quickly mixes the contents of the can.

BRIEF DESCRIPTION OF THE DRAWINGS

In the accompanying drawings forming part hereof similar elements have been given the same reference numerals in which drawings:

FIG. 3 is a rear view of the machine shown in FIG. 1.

FIG. 4 is a fragmentary view somewhat enlarged, taken on line 4—4 in FIG. 2.

FIG. 5 is a fragmentary view somewhat enlarged, taken on line 5—5 in FIG. 1.

DETAILS OF THE DRAWINGS

Figure 2:
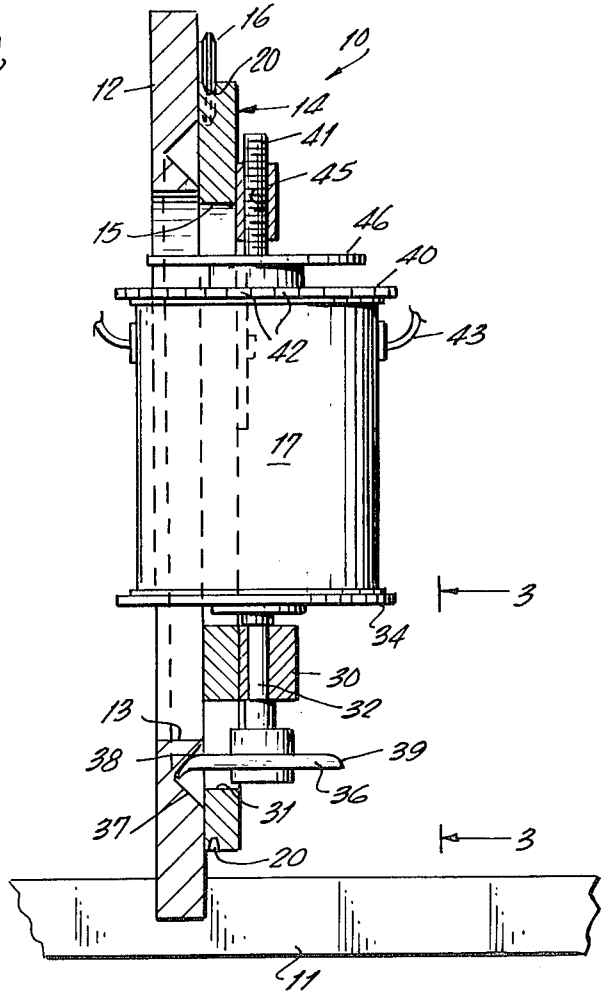
FIG. 2 is a sectional view taken on line 2—2 in FIG. 1.
Figure 1:
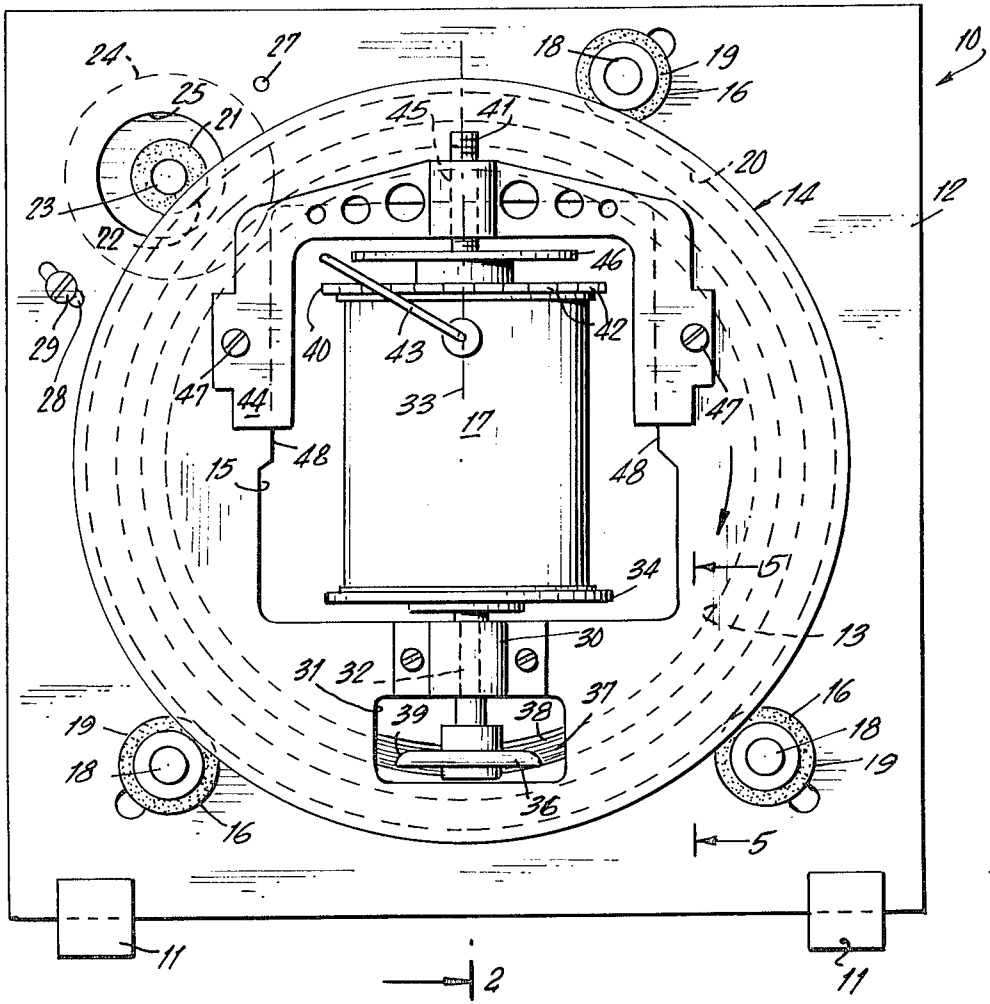
FIG. 1 is a view in front elevation of a complete embodiment of a paint mixing and conditioning machine made in accordance with the present invention.

Referring to the drawings and specifically to FIGS. 1 and 2, 10 indicates a complete embodiment of the paint mixing and conditioning machine made in accordance with the present invention. The machine is mounted upon a base support 11 to which there is attached a vertical support plate 12 made of steel, aluminum or other suitable rigid material. A circular aperture 13 is provided in the vertical support plate 12 and is preferably centrally located on said plate. The circular aperture is of a size to receive a rotating member container 17 for the paint to be conditioned, as hereinafter more fully described.

A flat pulley shaped disc 14 having a window 15 therein is peripherally and rotatably carried on the support plate by molded resilient wheels 16 which are secured to the vertical support plate 12 by means of stub shafts upon which the wheels 16 are freely carried. The molded wheels are made of resilient urethane or some other wear resistant plastic or rubber material. Each of the wheels 16 is provided with a peripheral flange 19 which is received within an annular groove 19 in the periphery of the pulley shaped disc 14. The wheels 16 are in frictional contact with the annular groove 20 at all times and also serve as a shock absorbing mount for the vertical support plate 12.

The pulley shaped disc 14 is drivably supported by a resilient drive wheel 21 which engages the said disc within the annular groove 20 as shown at 22. The drive wheel 21 is secured to the output shaft 23 of a source of rotary power such as the motor 24, best shown in FIG. 3. The output shaft 23 extends through a bore 25 in the vertical support plate 12. It will be seen from an examination of FIG. 3, that the motor 24 is mounted upon a pivot plate 26 swingably mounted by a bolt 27 which is secured to the vertical support plate 12. A slot 28 in the pivot plate 26 and a pin 29 serve to limit the swing of the pivot plate 26. Since the pivot plate is free to swing about its bolt 27, the weight of the motor 24 maintains the drive wheel 21 in good frictional engagement with the annular groove 20 of the pulley shaped disc 14. In addition, this arrangement eliminates any need for noisy gears or gear trains for applying rotary power to the pulley shaped disc 14.

Referring again to FIGS. 1 and 2, it will be seen that a pillow block 30 is secured to the front face of the pulley shaped disc 14 between the edge of the window 15 and a rectangular opening 31 in the pulley shaped disc. A shaft 32 is freely carried within the pillow block 30 and extends out of back end of pillow block coaxial with vertical axis 33 of the container 17. A flat circular plate 34 (hereinafter referred to as the bottom plate) is secured to one end of the shaft 32. The plate 34 is provided with grooves 35 which are concentric with the center of said plate and of a size to receive containers, such as cans, of different diameters therein.

As best shown in FIG. 3, the bottom plate extends horizontally through the window 15 in the pulley shaped disc 14 and also through the circular aperture 13 in the support plate 12. As a result, the container of paint 17 is substantially balanced within the machine 10 with a minimum of overhang from the support plate 12.

The opposite end of the pillow block shaft 32 has secured thereto a beveled wheel 36, hereinafter called the friction drive wheel, formed of a suitable wear resistant resilient material such as urethane, neoprene or rubber. The friction drive wheel 36 rides within a complementary groove 37 cut into the face of the pulley shaped disc 14. The said disc groove 37 has a beveled wall 38 which makes good frictional contact with the beveled surface 39 of the friction drive wheel. It will be apparent that as the pulley shaped disc 14 is rotated by the motor 24, the friction drive wheel will turn, thereby rotating the container 17.

The container 17 is secured to the bottom plate 34 by means of a clamp plate 40 freely carried by a threaded stud 41 in spaced alignment with the shaft 32. Notches 42 in the periphery of the clamp plate 40 serve to anchor the handle 43 of the paint container 17 during rotation and tumbling of the said container.

A yoke 44 (best shown in FIG. 1) is adjustably secured to the pulley shaped disc 14 on the outer or pillow block face of the said disc. The threaded stud 41 is received within an internally threaded bore 45 in the yoke 44. Movement of the clamp plate 40 toward or away from the bottom plate 34 is effected by rotating a clamping wheel 46 secured to the threaded stud 41 between the yoke 44 and the clamp plate 40.

Where containers of substantially different sizes are to be mixed, the yoke 44 may be loosened by backing off set screws 47 on the yoke, sliding the yoke along ways 48 on the pulley shaped disc 14 until the desired spacing to receive the container is reached and then tightening the said set screws.

In one embodiment of the present invention suitable for mixing or conditioning paint, the source of rotary power was a $\frac{1}{4}$ horse power a/c electric motor having an output of 1725 RPM, the drive mechanism achieves approximately 4 times the RPM of the container 17 to that of the pulley shaped disc (the container rotates four times each revolution of the pulley shaped disc).

From the foregoing, it will be seen that the operation of the paint mixing and conditioning machine is as follows:

The yoke 44 is adjusted to the approximate height for the paint container size. The container is placed upon the bottom plate 34 with the can rim set into the groove 35 which matches the container size. The clamping wheel 46 is then turned until the container is firmly secured between the bottom and clamping plates 34,40. The handle 43 of the container is then raised and snapped into two spaced notches 42 on the top plate. Power is then applied to the motor 24 thereby driving the pulley-shaped disc 14 and causing the can to tumble about its horizontal axis while rotating about its longitudinal axis. The apparatus can be operated for a time interval long enough to achieve the desired mixing of the contents of the container. For containers of normal type of water base or oil base paints, this time interval is approximately 30 seconds depending upon the temperature of the contents and its condition prior to mixing. The motor 24 is then stopped, the clamping wheel 46 turned to release the clamp plate 40, following which the container may be removed from the apparatus.

While the above description has referred to mixing and conditioning paint, it will be apparent that a wide variety of liquid as well as solid materials may be used in the containers without departing from the spirit of the present invention.

Having thus fully described the invention, what is desired to be claimed and secured by Letters Patent is:

1. A paint mixing and conditioning machine comprising in combination:

(a) a base support;

(b) an upstanding support plate having an aperture therein secured to the base support;

(c) a plurality of spaced resilient wheels journaled in the upstanding support and extending outwardly therefrom;

(d) a pulley-shaped circular disc having a window therein in register with the support plate aperture, said disc being peripherally and rotatably carried by the spaced resilient wheels;

(e) a source of rotary power carried by the support plate;

(f) a resilient drive wheel secured to the power source and in frictional contact with the pulley-shaped circular disc;

(g) A first clamping plate to receive the bottom of the container for the paint;

(h) a second clamping plate to secure the said container against the first clamping plate; said first and second clamping plates being disposed normal to the support plate and the pulley shaped disc and extending through the aperture and window therein;

(i) means to urge the second clamping plate in the direction of the first clamping plate;

(j) a resilient friction drive wheel freely carried by the pulley shaped disc adjacent the first clamping plate in contact with the support plate;

(k) a shaft secured at one end to the drive wheel and at its opposite end to the first clamping plate; and (l) a stud carried by the clamping means, freely supporting the second clamping plate to permit rotational movement of the container.

2. A machine according to claim 1 in which the pulley-shaped disc is formed with a groove to receive the periphery of the resilient wheels and the drive wheel therein.

3. A machine according to claim 1 in which the source of rotary power is swingably carried by a pivot plate secured to the upstanding support plate to urge the drive wheel against the pulley-shaped disc.

4. A machine according to claim 1 in which the means to urge the second clamping plate in the direction of the first clamping plate comprises a yoke slidably carried by the pulley-shaped disc, a threaded bore in said yoke to receive the threaded stud, and a clamping wheel secured to the threaded stud for rotation of said stud.

5. A machine according to claim 4 in which the yoke is slidably carried upon ways formed on the sides of the pulley-shaped disc window.

6. A machine according to claim 1 in which the friction drive wheel is beveled and the support plate is formed with a complementary beveled annular groove to receive the beveled portion of the friction drive wheel therein.

* * * * *